US007779816B2

(12) United States Patent
Dölker

(10) Patent No.: US 7,779,816 B2
(45) Date of Patent: Aug. 24, 2010

(54) CONTROL AND REGULATION METHOD FOR AN INTERNAL COMBUSTION ENGINE PROVIDED WITH A COMMON-RAIL SYSTEM

(75) Inventor: Armin Dölker, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 269 days.

(21) Appl. No.: 11/922,837

(22) PCT Filed: Jun. 22, 2006

(86) PCT No.: PCT/EP2006/006016

§ 371 (c)(1),
(2), (4) Date: Dec. 21, 2007

(87) PCT Pub. No.: WO2006/136414

PCT Pub. Date: Dec. 28, 2006

(65) Prior Publication Data

US 2009/0223488 A1 Sep. 10, 2009

(30) Foreign Application Priority Data

Jun. 23, 2005 (DE) ..... 10 2005 029 138

(51) Int. Cl.
*F02M 69/46* (2006.01)
*F02M 59/36* (2006.01)

(52) U.S. Cl. ..... 123/456; 123/458

(58) Field of Classification Search ..... 123/446, 123/447, 456, 458, 497; 701/104
See application file for complete search history.

(56) References Cited

U.S. PATENT DOCUMENTS

| | | | | |
|---|---|---|---|---|
| 3,704,963 | A * | 12/1972 | Baxter | 417/274 |
| 4,079,719 | A * | 3/1978 | Varcoe et al. | 123/502 |
| 4,166,437 | A * | 9/1979 | Bianchi et al. | 123/406.44 |
| 4,214,307 | A * | 7/1980 | Peterson et al. | 701/110 |
| 4,884,545 | A * | 12/1989 | Mathis | 123/447 |
| 6,138,504 | A * | 10/2000 | Lewis et al. | 73/114.33 |
| 6,293,253 | B1 * | 9/2001 | Arnold et al. | 123/458 |
| 6,367,452 | B1 * | 4/2002 | Shima et al. | 123/457 |
| 6,497,223 | B1 * | 12/2002 | Tuken et al. | 123/497 |
| 6,840,220 | B2 * | 1/2005 | Yomogida et al. | 123/456 |
| 7,017,549 | B2 * | 3/2006 | Doelker | 123/399 |
| 7,207,305 | B2 * | 4/2007 | Dolker | 123/179.3 |
| 7,270,115 | B2 * | 9/2007 | Dolker | 123/467 |
| 7,352,072 | B2 * | 4/2008 | Dolker et al. | 290/30 A |
| 7,387,289 | B2 * | 6/2008 | Kubota et al. | 251/129.05 |
| 7,451,038 | B2 * | 11/2008 | Kosiedowski et al. | 701/103 |
| 7,606,656 | B2 * | 10/2009 | Dolker | 701/113 |
| 7,610,901 | B2 * | 11/2009 | Bucher et al. | 123/457 |
| 2008/0092852 | A1 * | 4/2008 | Bucher et al. | 123/457 |

FOREIGN PATENT DOCUMENTS

DE 197 31 995 1/1999

(Continued)

*Primary Examiner*—Stephen K Cronin
*Assistant Examiner*—David Hamaoui
(74) *Attorney, Agent, or Firm*—Lucas & Mercanti, LLP; Klaus P. Stoffel

(57) ABSTRACT

An open-loop and closed-loop control method for an internal combustion engine (1) with a common rail injection system, in which a rail pressure (pCR) is subject to closed-loop control during normal operation. A second actual rail pressure is determined by a second filter, a load reduction is detected when the second actual rail pressure exceeds a first limit, and when a load reduction is detected, the rail pressure (pCR) is controlled by setting the PWM signal (PWM) to a PWM value that is increased compared to normal operation by a PWM assignment unit.

6 Claims, 7 Drawing Sheets

FOREIGN PATENT DOCUMENTS

| | | |
|---|---|---|
| DE | 101 60 311 | 6/2003 |
| DE | 102 61 446 | 7/2004 |
| DE | 103 30 466 | 10/2004 |
| DE | 102004023365 | 12/2005 |
| EP | 1 136 686 | 9/2001 |
| EP | 0 892 168 | 4/2004 |
| GB | 2327777 | 2/1999 |
| WO | WO2004061285 | 7/2004 |

* cited by examiner

CONTROL AND REGULATION METHOD FOR AN INTERNAL COMBUSTION ENGINE PROVIDED WITH A COMMON-RAIL SYSTEM

This is a U.S. National Stage of application No. PCT/EP2006/006016, filed on Jun. 22, 2006. Priority is claimed on that application and on the following application:

Country: Germany, Application No.: 10 2005 029 138.4 Filed: Jun. 23, 2005.

BACKGROUND OF THE INVENTION

The invention concerns an open-loop and closed-loop control method for an internal combustion engine with a common rail injection system, in which the rail pressure is subject to closed-loop control during normal operation.

In a common rail system, a high-pressure pump pumps the fuel from a fuel tank into a rail. The admission cross section to the high-pressure pump is determined by a variable suction throttle. Injectors are connected to the rail. They inject the fuel into the combustion chambers of the internal combustion engine. Since the quality of the combustion is decisively determined by the pressure level in the rail, this pressure is automatically controlled. The closed-loop high pressure control system comprises a pressure controller, the suction throttle with the high-pressure pump, and the rail as the controlled system. Typically, the pressure controller is realized as a PID controller or a PIDT1 controller, that is, it comprises at least a proportional component (P component), an integral component (I component), and a differential component (D component). In this closed-loop high pressure control system, the controlled variable is the pressure level in the rail. The measured pressure values in the rail are converted by a filter to an actual rail pressure and compared with a set rail pressure. The control deviation obtained by this comparison is converted to a control signal for the suction throttle by the pressure controller. The control signal corresponds, e.g., to a volume flow in liters/minute units. The control signal is typically electrically generated as a PWM signal (pulse-width-modulated signal). The closed-loop high pressure control system described above is disclosed by DE 103 30 466 B3.

To protect against an excessively high pressure level, a passive pressure control valve is installed in the rail. If the pressure level is too high, the pressure control valve opens to conduct fuel from the rail back into the fuel tank.

The following problem can arise under practical conditions: a load reduction is immediately followed by an increase in engine speed. At a constant set speed, an increasing engine speed causes an increase in the magnitude of the speed control deviation. A speed controller responds to this by reducing the injection quantity as a correcting variable. A smaller injection quantity in turn causes less fuel to be taken from the rail, so that there is a rapid increase in the pressure level in the rail. The situation is further complicated by the fact that the output of the high-pressure pump depends on the engine speed. An increasing engine speed means a higher pump output, and this produces a further increase in pressure in the rail. Since the high pressure control system has a relatively long response time, the rail pressure can continue to rise until the pressure control valve opens, e.g., at 1,950 bars. This causes the rail pressure to drop, e.g., to a value of 800 bars. At this pressure level, an equilibrium state develops between fuel pumped in and fuel removed. This means that, despite the opened pressure control valve, the rail pressure does not drop further. The pressure control valve does not close again until the speed of the internal combustion engine is reduced. Therefore, the unexpected opening of the pressure control valve after a load reduction is a problem.

The German Patent Application with the official file number DE 10 2004 023 365.9, for which a prior printed publication has not yet appeared, also describes a closed-loop pressure control system for a common rail system. In this closed-loop pressure control system, in addition to the first filter, a second filter is located in the feedback path. The second filter has a smaller time constant and a smaller phase delay than the first filter. The actual rail pressure determined by the second filter is used for the calculation of the controller components. This results in an improved dynamic response of the closed-loop high pressure control system in the event of a load reduction.

It remains critical, however, that the control signal or the PWM signal is strongly limited by the electrical characteristics of the electronic control unit, e.g., maximum continuous current and dissipation of the output transistor. This means that, at a large control deviation, although the pressure controller computes a maximum correcting variable, this variable ultimately can be converted to a PWM signal with only, e.g., 22% pulse to no-current ratio. A permanently applied higher PWM value would cause deactivation of the output stage of the electronic control unit.

SUMMARY OF THE INVENTION

The objective of the invention is to improve the reliability of the automatic pressure control during a load reduction.

The invention provides that a second actual rail pressure is determined from the rail pressure by a second filter, and a load reduction is detected when the second actual rail pressure exceeds a limit. When a load reduction is detected, the rail pressure is then controlled by setting the PWM signal to a PWM value that is increased compared to normal operation by a PWM assignment unit. This increased PWM value is preset for an interval of time, e.g., as a step function.

The central idea of the invention is to significantly accelerate the closing operation of the suction throttle by presetting a high PWM value. A suction throttle is used that works against a spring during closing, i.e., which is open in the currentless state. If the PWM signal is increased, the displacement of the suction throttle slide is increased, and the opening cross section of the suction throttle is reduced. In practice, it is sufficient to allow this PWM preset value to be active for a very short time interval, e.g., 20 milliseconds. The brief introduction of higher energy into the suction throttle results in a higher dynamic response of the actuator. Unintended opening of the pressure control valve is thus suppressed.

A further advantage of the invention is that, if the suction throttle slide is stuck, the increased preset energy value causes it to run well again.

A preferred embodiment of the invention is illustrated in the drawings.

DETAILED DESCRIPTION OF THE INVENTION

Figure 1:
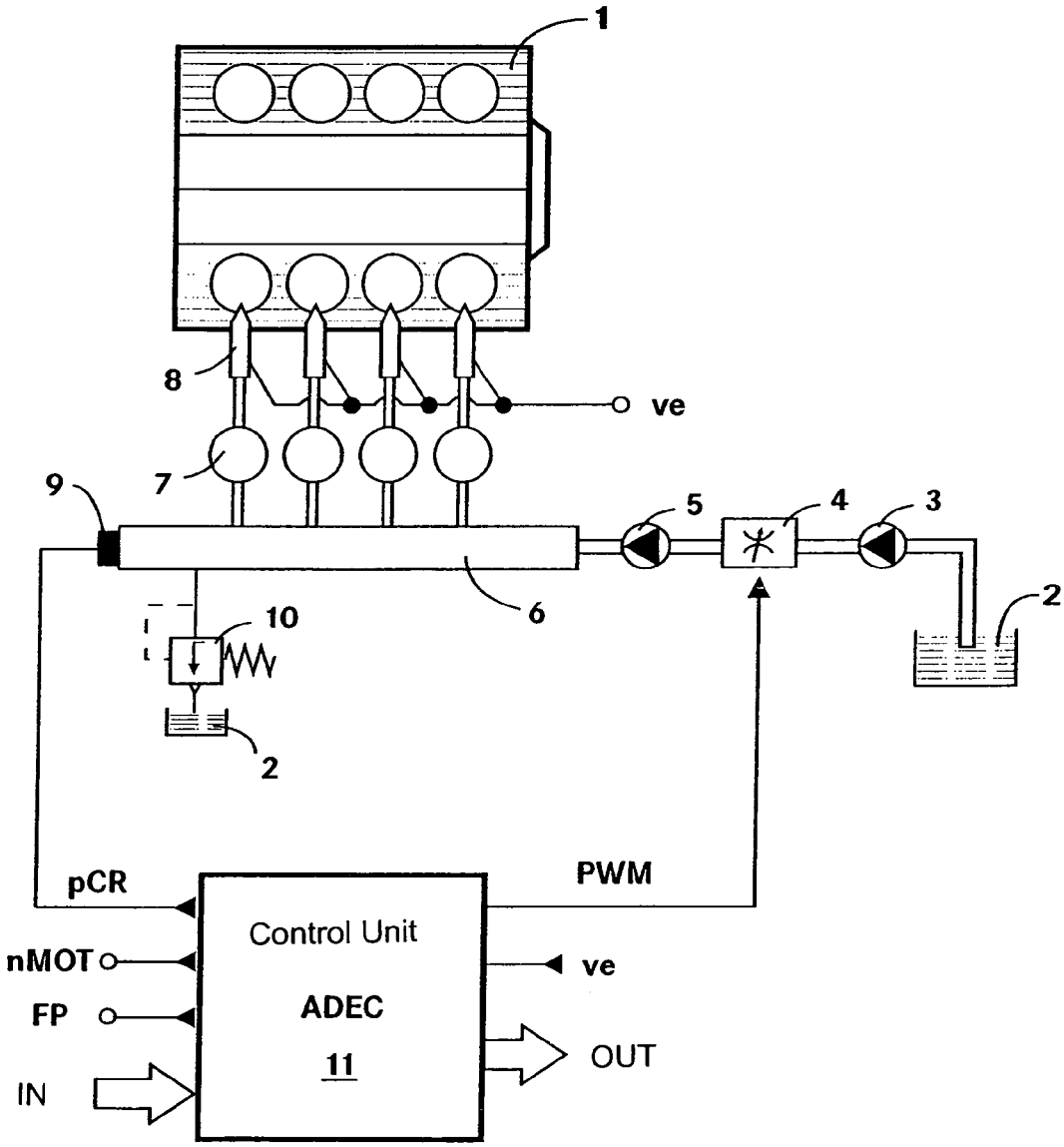
FIG. 1 shows a system diagram.

FIG. 1 shows a system diagram of an internal combustion engine 1 with a common rail injection system. The common rail system comprises the following components: a low-pressure pump 3 for delivering fuel from a fuel tank 2, a variable suction throttle 4 for controlling the volume flow of the fuel flowing through the system, a high-pressure pump 5 for pumping the fuel at increased pressure, a rail 6 and individual accumulators 7 for storage of the fuel, and injectors 8 for injecting the fuel into the combustion chambers of the internal combustion engine 1.

This common rail system is operated at a maximum steady-state rail pressure of, e.g., 1,800 bars. To protect against an impermissibly high pressure level in the rail 6, a passive pressure control valve 10 is provided. It opens at a pressure level of, e.g., 1,950 bars. In the opened state, the fuel is routed out of the rail 6 and into the fuel tank 2 via the pressure control valve 10. This causes the pressure level in the rail 6 to drop to a value of, e.g., 800 bars.

The mode of operation of the internal combustion engine 1 is determined by an electronic control unit (ADEC) 11. The electronic control unit 11 contains the usual components of a microcomputer system, for example, a microprocessor, I/O modules, buffers, and memory components (EEPROM, RAM). Operating characteristics that are relevant to the operation of the internal combustion engine 1 are applied in the memory components in input-output maps/characteristic curves. The electronic control unit 11 uses these to compute the output variables from the input variables. FIG. 1 shows the following input variables as examples: the rail pressure pCR, which is measured by means of a rail pressure sensor 9, an engine speed nMOT, a signal FP, which represents an engine power output desired by the operator, and an input variable IN. Examples of input variables IN are the charge air pressure of the exhaust gas turbochargers and the temperatures of the coolants/lubricants and the fuel.

As output variables of the electronic control unit 11, FIG. 1 shows a signal PWM for controlling the suction throttle 4, a signal ve for controlling the injectors 8, and an output variable OUT. The output variable OUT is representative of additional control signals for the open-loop and closed-loop control of the internal combustion engine 1, for example, a control signal for activating a second exhaust gas turbocharger in register supercharging.

Figure 2:
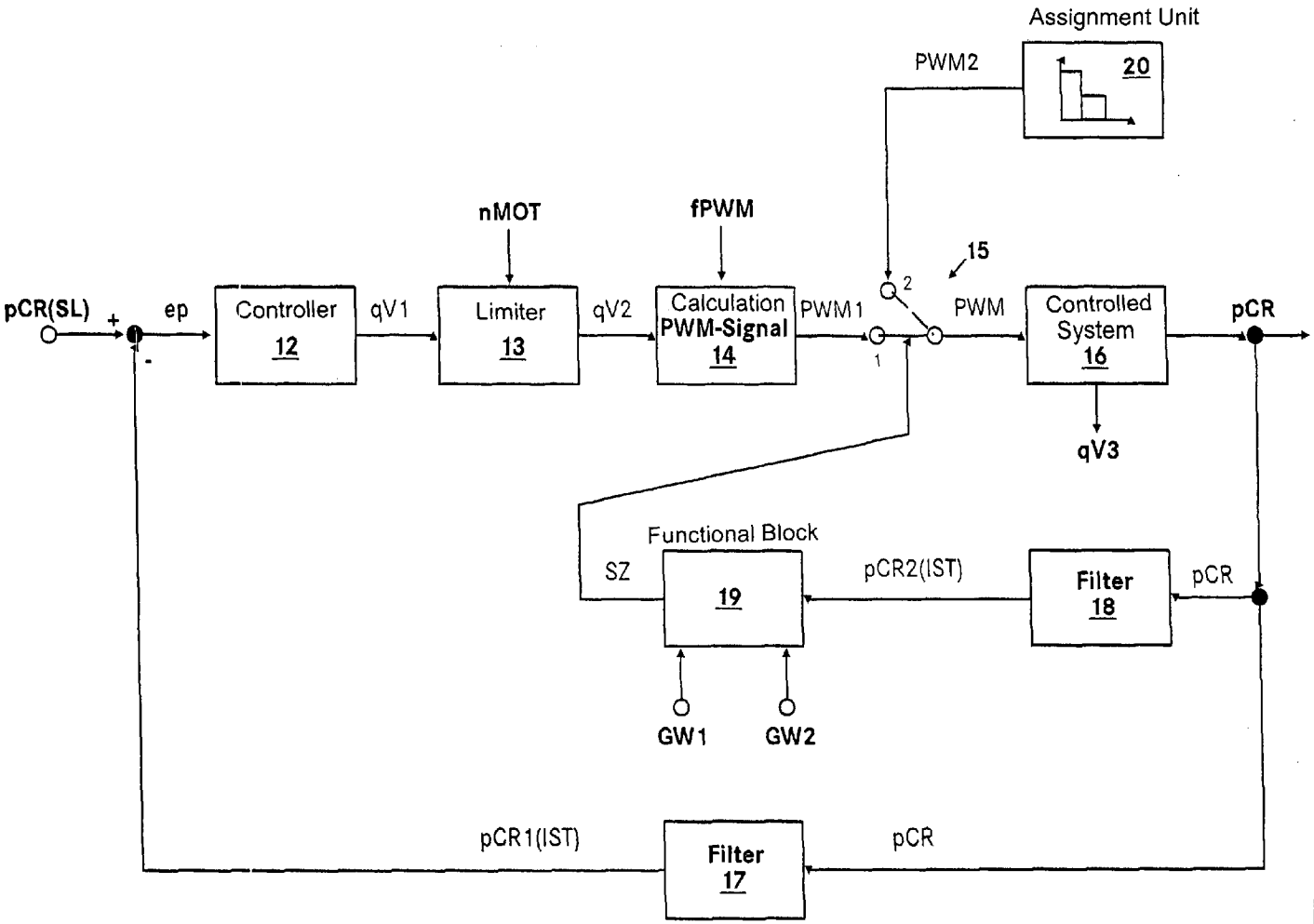
FIG. 2 shows a closed-loop pressure control system.

FIG. 2 shows a closed-loop pressure control system. The input variable is a set rail pressure pCR(SL), and the output variable corresponds to the raw value of the rail pressure pCR. A first actual rail pressure PCR1(IST) is determined from the raw value of the rail pressure pCR by means of a first filter 17. This value is compared with the set value pCR(SL) at a summation point, and a control deviation ep is obtained from this comparison. A correcting variable is calculated from the control deviation ep by means of a pressure controller 12. The correcting variable represents a volume flow qV1. The physical unit of the volume flow is liters/minute. In an optional provision, the calculated set consumption is added to the volume flow qV1. The volume flow qV1 is the input variable for a limiter 13, which can be made speed-dependent by using nMOT as an input variable. The output variable qV2 of the limiter 13 is then converted to a PWM signal PWM1 in a calculation unit 14. In this regard, the PWM signal PWM1 represents the duty cycle, and the frequency fPWM corresponds to the base frequency. Fluctuations in the operating voltage and the fuel admission pressure are also taken into consideration in the conversion. The magnetic coil of the suction throttle is then acted upon by the PWM signal PWM1. This changes the displacement of the magnetic core, and the output of the high-pressure pump is freely controlled in this way. The high-pressure pump, the suction throttle, the rail, and the individual accumulators represent a controlled system 16. A set consumption volume flow qV3 is removed from the rail 6 through the injectors 8. The closed-loop control system is thus closed.

The closed-loop control system described above is supplemented by a second filter 18, a functional block 19, a PWM assignment unit 20, and a switch 15. The switch 15 is located in the signal path between the calculation unit 14 and the controlled system 16. The switching state of the switch 15 is set by a signal SZ, which is determined by the functional block 19 as a function of a first limit GW1, a second limit GW2, and a second actual rail pressure pCR2(IST). The second actual rail pressure pCR2(IST) in turn is calculated by the second filter 18 from the raw value of the rail pressure pCR.

In FIG. 2, the switch 15 is shown in position 1, i.e., the signal PWM1 determined by the calculation unit 14 is the input variable of the controlled system 16. In position 2 of the switch 15, a signal PWM2 is the input signal for the controlled system 16. The signal PWM2 is generated by the PWM assignment unit 20.

The system illustrated in the functional block diagram of FIG. 2 works as follows:

In normal operation, the switch 15 is in position 1, i.e., the correcting variable qV1 calculated by the pressure controller 12 is limited and converted to a PWM signal PWM1, which acts on the controlled system 16. If the second actual rail pressure pCR2(IST) exceeds the first limit GW1, the functional block 19 changes the signal level of the signal SZ, which causes the switch 15 to change to position 2. In this position, a PWM value PWM2 that is increased compared to the normal operation is temporarily output by the PWM assignment unit 20. In other words, the system changes from a closed-loop control operation to an open-loop control operation. After a predetermined period of time has elapsed, the switch 15 then returns to position 1.

Figure 3A:
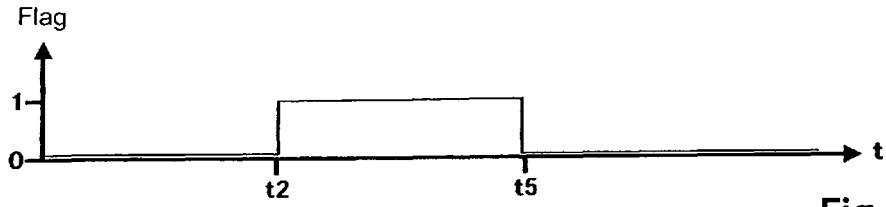
FIG. 3 shows a timing chart.
Figure 3B:
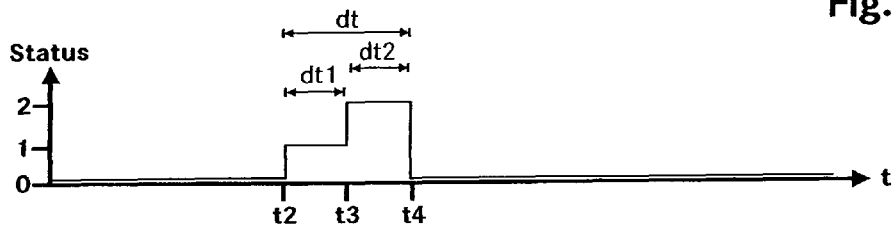
Figure 3C:
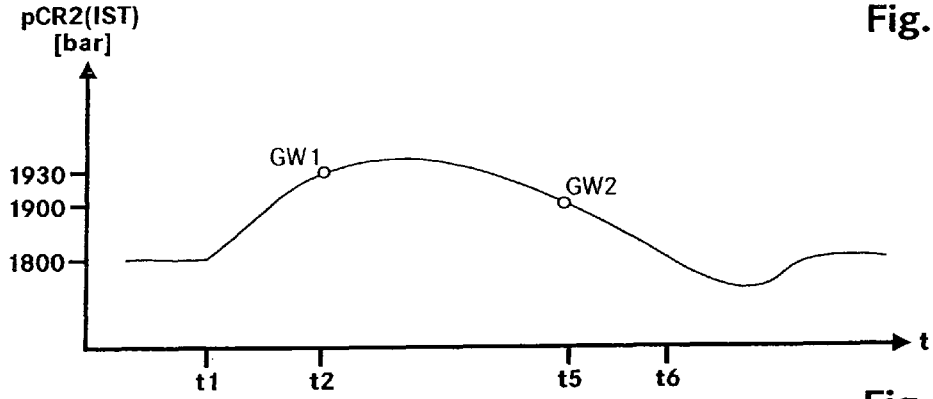
Figure 3D:
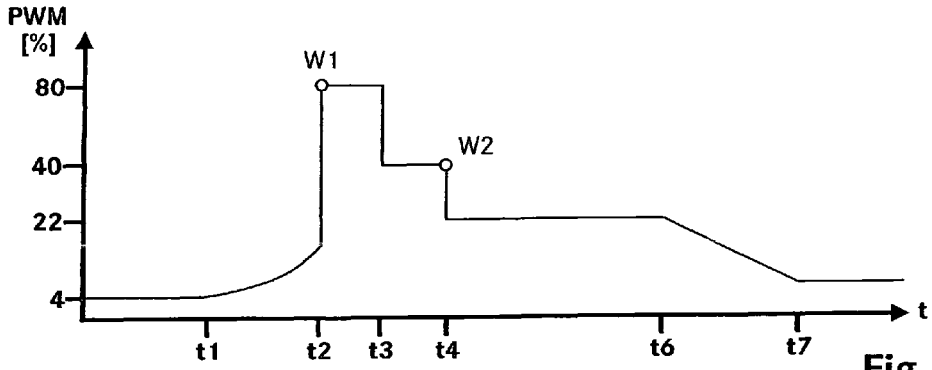

FIG. 3 comprises FIGS. 3A to 3D, which show, in each case as a function of time, the logical switching state of a flag in FIG. 3A, a status in FIG. 3B, a curve of the second actual rail pressure pCR2(IST) in FIG. 3C, and the behavior of the PWM signal as input variable of the controlled system 16 in FIG. 3D. Percentages are plotted on the PWM ordinate, e.g., 40% PWM signal means a corresponding pulse to no-current ratio of 0.4 at constant PWM base frequency fPWM. At time t1, the system is in normal operation, i.e., the rail pressure pCR is automatically controlled by the pressure controller 12. The flag and the status have a value of 0. The pressure level in the rail is 1,800 bars. The PWM signal in FIG. 3D has an exemplary value of 4%. After time t1, the rail pressure pCR and thus the second actual rail pressure pCR2(IST) start to increase as the result of a load reduction. In practice, a load reduction corresponds to the shutting down of a consuming unit in the case of generator operation or to the broaching of a ship's propulsion unit. An increasing rail pressure pCR produces a likewise quantitatively increasing control deviation ep at a constant preset value of the set rail pressure. This control deviation ep is converted by the pressure controller 12 into an increasing PWM signal, which results in reduction of the cross section of the suction throttle. Therefore, in FIG. 3D, the value of the PWM signal increases from the initial value of 4%. In practice, the PWM signal can assume a maximum value of, e.g., 22%, in automatic control operation. This maximum value is determined by the supply voltage and the greatest possible suction throttle continuous current, e.g., 24 volts and 2 amperes.

At time t2, the second actual rail pressure pCR2(IST) exceeds the first limit GW1 of 1,930 bars. When this limit is exceeded, the flag is set to the value of 1 (FIG. 3A), and the status is changed from 0 to 1. The closed-loop control of the rail pressure is thus deactivated, and the PWM signal in FIG. 3D is subject to open-loop control by the PWM assignment unit 20 during a time interval dt. In FIG. 3B, a step function is shown as an example of a predetermined function. Other mathematical functions are possible, e.g., a parabola. At time t2, therefore, the PWM signal is set to a higher PWM value. In FIG. 3, this corresponds to the point W1 with the associated ordinate value of 80%. At time t3, a first time interval dt1 has elapsed, i.e., the status changes from 1 to 2, and as a result the PWM signal in FIG. 3D is reduced from the value of 80%, point W1, to the value of 40%, point W2. During a second time interval dt2, the PWM signal remains unchanged. When the second time interval dt2 has elapsed, and the time interval dt comes to an end, the I component of the pressure controller is initialized. Either zero or a value that corresponds to the negative of the set consumption volume flow qV3 is set as the initialization value. In practice, the time interval dt is set at 20 ms. Due to the relatively short period of time, the maximum dissipation of the output stage is not exceeded.

After initialization of the pressure controller, the open-loop control operation is ended, and the rail pressure is again automatically controlled by closed-loop control. Since at time t4 the rail pressure pCR or the second actual rail pressure pCR2(IST) has an elevated level compared to normal operation, the pressure controller computes the maximum possible PWM signal for the closed-loop operation, corresponding to 22% (FIG. 3D). At time t5, the second actual rail pressure pCR2(IST) falls below a second limit GW2 of 1,900 bars, and when this happens, the flag is set to the value of 0. This releases the open-loop control again, i.e., the function could be activated again. As shown in FIG. 3C, the second actual rail pressure pCR2(IST) decreases due to the closed suction throttle. At time t6, it is assumed that the second actual rail pressure pCR2(IST) falls below the initial pressure level of 1,800 bars. As a consequent reaction, the pressure controller lowers the PWM signal back to the initial value of 4% at time t7.

Figure 4:
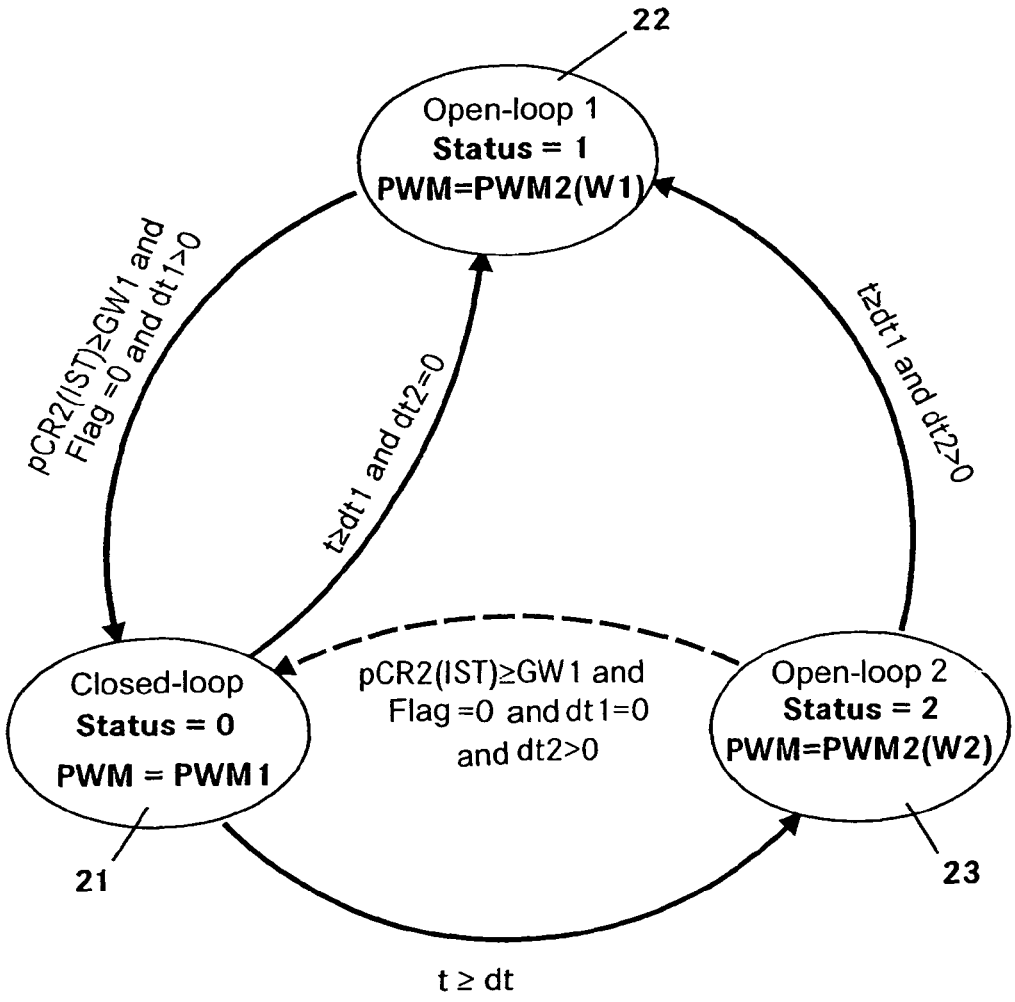
FIG. 4 shows a state transition diagram.

FIG. 4 shows a state transition diagram for the transitions from the closed-loop control operation to the open-loop control operation and vice versa. The diagram also shows optional transitions when only the first time interval dt1 (dt1>0) and/or the second time interval dt2 (dt2 0) was activated by the user. Reference number 21 indicates activated closed-loop control of the rail pressure. During closed-loop control operation, the status has a value of 0, and the PWM signal has the value PWM1, which is preset by the pressure controller and serves as the input variable of the controlled system. If the second actual rail pressure pCR2(IST) exceeds the first limit GW1, a load reduction is detected. When the load reduction has been detected and the first time interval dt1 has been activated (dt1>0), a switch is made to the state open-loop control 1 (reference number 22). In this state, the status has a value of 1, and the PWM signal for acting on the controlled system is subject to open-loop control by the PWM assignment unit 20 (output signal PWM2). The PWM signal is temporarily set to the value of point W1 by the PWM assignment unit. When the first time interval dt1 has elapsed and the second time interval dt2 has been activated (dt2>0), a switch is made to the state open-loop control 2 (reference number 23). In this state, the status has a value of 2, and the PWM signal is set to the value of point W2 by the PWM assignment unit. When the second time interval dt2 and thus the time interval dt elapse, a switch is made from the state open-loop control 2 to the state closed-loop control (reference number 21). The open-loop control of the rail pressure is thus deactivated, and the closed-loop control is reactivated.

If a load reduction is detected in the closed-loop control operation, state closed-loop control, and a first time interval dt1 was not activated by the user (dt1=0), a switch is made directly to the state open-loop control 1. The system returns from the state open-loop control 2 to the closed-loop control operation when the time interval dt elapses.

In the state open-loop control 1 (reference number 22), the transition to the state closed-loop control or to the state open-loop control 2 is made as a function of the second time interval dt2. If the user has not activated a second time interval dt2 (dt2=0), the system returns directly to the closed-loop control operation when the first time interval dt1 has elapsed. If the user has activated a second time interval dt2, then, as described above, a switch is made to the state open-loop control 2.

Figure 5:
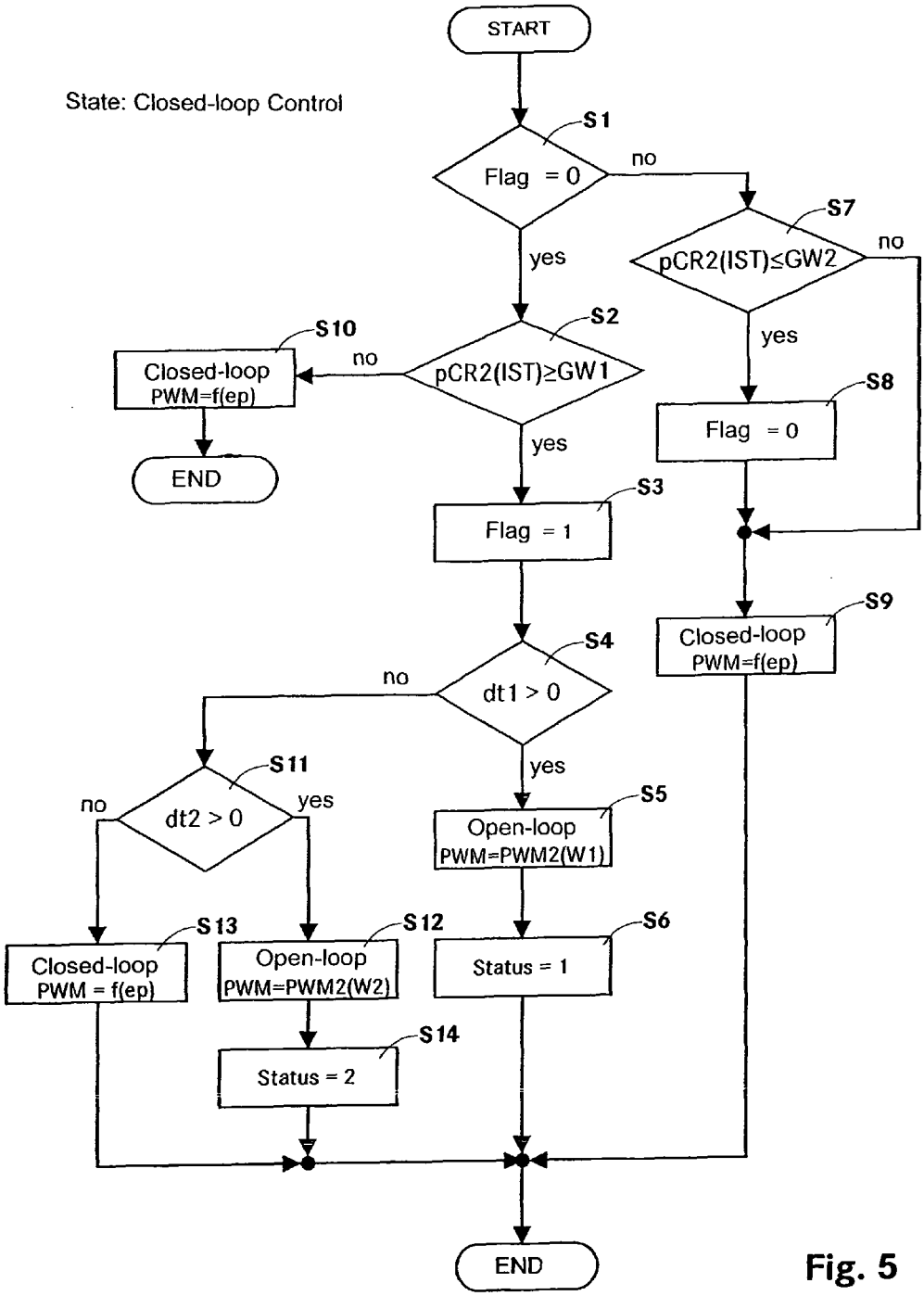
FIG. 5 shows a program flowchart.

FIG. 5 shows a program flowchart for the closed-loop control state. At S1 a test is made to determine whether the flag has a value of 0. If the test result is positive, the routine with the steps S2 to S14 is carried out. If the test result is negative, the routine with the steps S7 to S9 is carried out.

If the test at S1 reveals that the flag has a value of 0, then a test is made at S2 to determine whether a load reduction is present. If the second actual rail pressure pCR2(IST) is below the first limit GW1, then at S10 the closed-loop control of the rail pressure is continued, i.e., the PWM signal is a function of the control deviation ep. This routine is then ended. If a load reduction is determined at S2, then at S3 the flag is set to a value of 1, and at S4 a test is performed to determine whether the first time interval dt1 was activated by the user. If the time interval has been activated (interrogation result: yes), then at S5 the PWM signal is controlled by the PWM assignment unit, in this case to the value PWM2(W1). Then the status is set to the value 1 at S3, and this routine is ended.

If the first time interval dt1 was not activated, i.e., the interrogation result at S4 is negative, then a test is performed at S11 to determine whether the second time interval dt2 was activated by the user. If the second time interval dt2 was not activated (interrogation result at S11: no), then the closed-loop control of the rail pressure remains activated at S13. The program flow path S4, S11, and S13 thus takes into account the case that the function was not activated by the user. If the test at S11 determines that the second time interval dt2 was activated, then at S12 the PWM signal is set to the value PWM2(W2). Then the status is set to the value 2 at S14, and this routine is ended.

If the test at S1 reveals that the flag does not have the value 0, then a test is performed at S7 to determine whether the second actual rail pressure pCR2(IST) is less than or equal to the second limit GW2. If this is the case, then at S8 the flag is set to the value 0, and the program flow continues at S9. If the test at S7 determines that the second actual rail pressure is above the second limit, the program flows to S9, and the closed-loop control of the rail pressure pCR remains activated. This routine is then ended.

Figure 6:
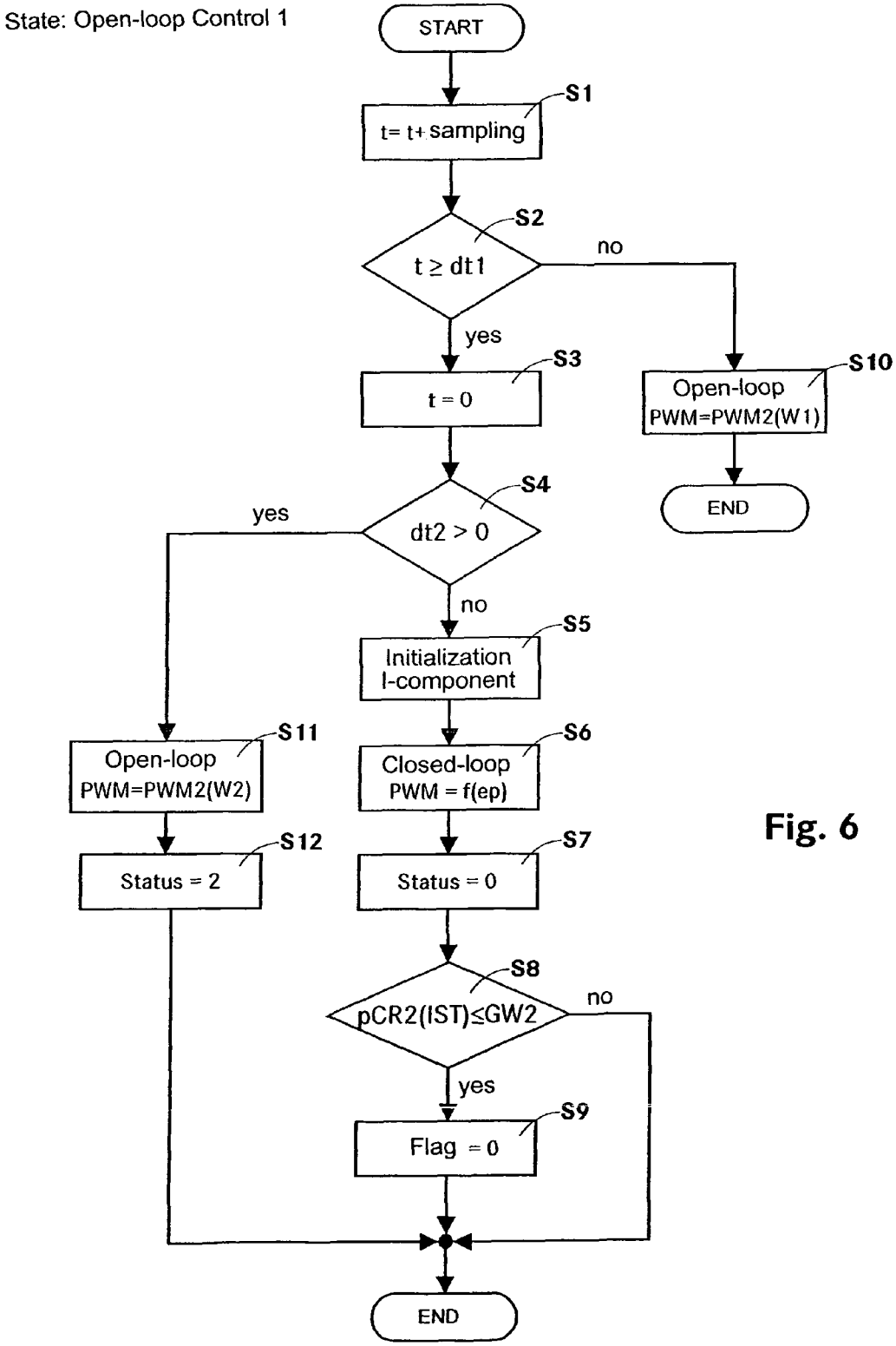
FIG. 6 shows a program flowchart.

FIG. 6 shows a program flowchart for the temporary PWM assignment when the first time interval dt1 has been activated, state: open-loop control 1. At S1 a time t is set to the value t plus sampling time. At S2 a test is performed to determine whether this time is greater than or equal to the first time interval dt1, i.e., whether the first time interval has already elapsed. If the first time interval has not yet elapsed (interrogation result: no), then at S10 the PWM signal is set to the value PWM2(W1), e.g., 80%, and this routine is then ended. If the test at S2 determines that the first time interval dt1 has elapsed, then at S3 the time is set to the value 0, and at S4 a test is performed to determine whether the second time interval dt2 was activated by the user. If the second time interval dt2 was not activated, flow passes to the routine with the steps S5 to S9. If the second time interval dt2 was activated, flow passes to the routine with the steps S11 to S12.

In the case in which the second time interval dt2 was not activated (interrogation result at S4: no), at S5 the I component of the pressure controller is initialized. The value 0 or a value that corresponds to the negative of the set consumption volume flow qV3 can be used as the initialization value. At S6 the closed-loop control of the rail pressure is then activated, i.e., the PWM signal is calculated by the pressure controller as a function of the control deviation ep. At S7 the status is then set to the value 0. At S8 a test is performed to determine whether the second actual rail pressure pCR2(IST) is less than or equal to the second limit GW2. If this is the case, then at S9 the flag is set to the value 0, and the routine is ended. If the test at S8 determines that the second actual rail pressure pCR2(IST) is greater than the second limit GW2, then this routine is ended immediately.

If the test at S4 determines that the second time interval dt2 was set, then at S11 the PWM signal is set by the PWM assignment unit to the value of the point W2 (output signal PWM2). The status is then set to the value 2 at S12, and the routine is ended.

Figure 7:
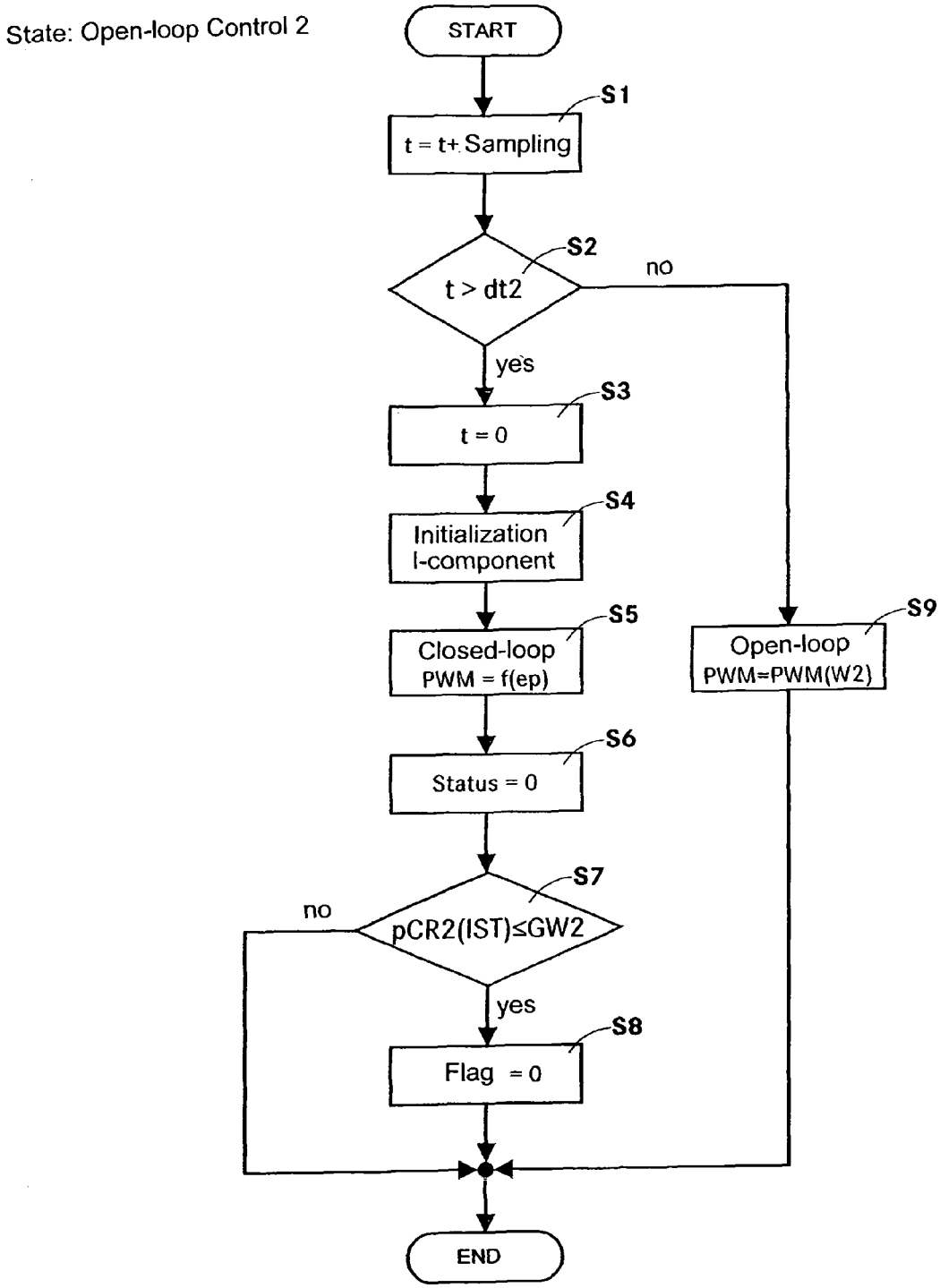
FIG. 7 shows a program flowchart.

FIG. 7 shows a program flowchart for the state open-loop control 2. At S1 a sampling time is added to a time t. A test is then performed at S2 to determine whether the second time interval dt2 has elapsed. If this is not the case (interrogation result at S2: no), then at S9 the PWM signal is set to the value PWM2(W2) by the PWM assignment unit, and the routine is ended. If the test at S2 determines that the second time interval dt2 has elapsed, then at S3 the time t is set to the value 0, and at S4 the I component of the pressure controller is initialized as previously described. At S5 the closed-loop control system is then activated, i.e., the PWM signal is determined as a function of the control deviation ep. At S6 the status is set to the value 0. At S7 a test is performed to determine whether the second actual rail pressure pCR2(IST) is less than or equal to the second limit GW2. If this is the case, then at S8 the flag is set to the value 0, and the routine is ended. If the test at S7 determines that the second actual rail pressure pCR2(IST) is greater than the second limit GW2, then the routine is ended immediately.

The method is described on the basis of a load reduction. In practice, the method described here can also be used, very generally, whenever a very rapid reduction of the injection quantity causes an excessive pressure increase in the rail. This occurs during a load reduction, during an engine stop and during a sudden reduction of the set torque or the set injection quantity with the detection of a supercharger overspeed in an exhaust gas turbocharger.

The invention offers the following advantages:

as a result of the temporarily increased PWM signal, a higher dynamic response of the actuator is achieved, so that unintended opening of the pressure control valve during a load reduction is prevented;

due to the deactivation of the closed-loop control and the increased PWM signal, a suction throttle slide that has become stuck can run correctly again;

the second filter, the switch and the PWM assignment unit can be reproduced in the software of the electronic control unit, and as a result the open-loop control method can be subsequently applied;

the temporary PWM assignment can supplement the method described in DE 10 2004 023 365.9.

The invention claimed is: 7

1. An open-loop and closed-loop control method for an internal combustion engine with a common rail injection system, in which a rail pressure (pCR) is subject to closed-loop control during normal operation, comprising the steps of:

determining a first actual rail pressure (pCR1(IST)) from the rail pressure (pCR) by a first filter;

calculating a control deviation (ep) from a set rail pressure (pCR(SL)) and the first actual rail pressure (pCR1 (IST));

calculating a correcting variable (qV1) from the control deviation (ep) with a pressure controller;

determining a PWM signal (PWM) for controlling a controlled system as a function of the correcting variable (qV1), the PWM signal having a constant base frequency;

determining a second actual rail pressure (pCR2(IST)) by a second filter;

detecting a load reduction when the second actual rail pressure (pCR2(IST)) exceeds a first limit (GW1); and, when a load reduction is detected, controlling the rail pressure (pCR) by open-loop control by setting the PWM signal (PWM) to a PWM value (PWM2) that is increased compared to normal operation by a PWM assignment unit. ,17

2. The open-loop and closed-loop control method in accordance with claim 1, including presetting the increased PWM value (PWM2) for an interval of time (dt).

3. The open-loop and closed-loop control method in accordance with claim 2, wherein, within the time interval (dt), the increased PWM value (PWM2) is preset according to a step function.

4. The open-loop and closed-loop control method in accordance with claim 2, including, after the time interval (dt) has elapsed, initializing an I component of the pressure controller with a value of zero or a value that corresponds to the negative of a set consumption volume flow (qV3).

5. The open-loop and closed-loop control method in accordance with claim 4, including again subjecting the rail pressure (pCR) to closed-loop control in accordance with normal operation after initialization of the pressure controller.

6. The open-loop and closed-loop control method in accordance with claim 1, including releasing open-loop control for presetting an increased PWM value when the rail pressure (pCR) falls below a second limit (GW2).

* * * * *